US007688002B2

(12) United States Patent
Ashdown et al.

(10) Patent No.: US 7,688,002 B2
(45) Date of Patent: Mar. 30, 2010

(54) LIGHT EMITTING ELEMENT CONTROL SYSTEM AND LIGHTING SYSTEM COMPRISING SAME

(75) Inventors: Ian Ashdown, West Vancouver (CA); Paul Jungwirth, Burnaby (CA)

(73) Assignee: Koninklijke Philips Electronics N.V., Eindhoven (NL)

( * ) Notice: Subject to any disclaimer, the term of this patent is extended or adjusted under 35 U.S.C. 154(b) by 69 days.

(21) Appl. No.: 11/858,847

(22) Filed: Sep. 20, 2007

(65) Prior Publication Data

US 2008/0068192 A1 Mar. 20, 2008

Related U.S. Application Data

(60) Provisional application No. 60/845,948, filed on Sep. 20, 2006.

(51) Int. Cl.
*G05F 1/00* (2006.01)
*G09G 3/32* (2006.01)

(52) U.S. Cl. ..... 315/291; 315/307; 315/312; 315/185 S; 315/247; 345/82; 345/98; 345/212; 345/214

(58) Field of Classification Search ..... 315/291, 315/307–326, 224, 225, 185 S, 200 A, 247, 315/246; 345/82, 84, 98, 99, 102, 204, 211–214
See application file for complete search history.

(56) References Cited

U.S. PATENT DOCUMENTS

| | | | | |
|---|---|---|---|---|
| 7,317,403 | B2 * | 1/2008 | Grootes et al. | 340/815.45 |
| 7,403,107 | B2 * | 7/2008 | Ito et al. | 340/458 |
| 7,425,943 | B2 * | 9/2008 | Furukawa | 345/102 |
| 2004/0090403 | A1 * | 5/2004 | Huang | 345/82 |
| 2007/0257623 | A1 * | 11/2007 | Johnson et al. | 315/193 |
| 2007/0262724 | A1 * | 11/2007 | Mednik et al. | 315/125 |
| 2008/0001547 | A1 * | 1/2008 | Negru | 315/189 |

* cited by examiner

*Primary Examiner*—Tuyet Vo
(74) *Attorney, Agent, or Firm*—Mark L. Beloborodov

(57) ABSTRACT

A light-emitting element control system is described comprising a series connection of one or more LEE units, each comprising one or more LEEs and a unit activation module. The unit activation module associated with a LEE unit is configured to controllably activate, in response to a unit activation control signal, the one or more LEEs in that unit. A control module is operatively coupled to each of the unit activation modules and configured to provide the unit activation control signals thereto. A converting module is operatively coupled to the series connection of LEE units, adapted for connection to a source of power and configured to provide a drive current to the LEE units.

13 Claims, 7 Drawing Sheets

LIGHT EMITTING ELEMENT CONTROL SYSTEM AND LIGHTING SYSTEM COMPRISING SAME

CROSS-REFERENCE TO RELATED APPLICATION

This application claims the benefit of Provisional Application No. 60/845,948, filed Sep. 20, 2006.

FIELD OF THE INVENTION

The present invention pertains to the field of lighting systems, and in particular, to a light emitting element control system and lighting system comprising same.

BACKGROUND

Light-emitting diodes (LEDs) can effectively convert electrical energy into light. However, the characteristics of the light which is emitted by different but nominally equal LEDs under the same operating conditions can vary due to a number of different factors which can be caused by, for example, variations in device manufacturing and device assembly. These variations can exceed the requirements imposed by those LED illumination applications which can require that the light emitted from two or more LEDs closely match. This can be particularly important for spatially extended luminaires in which the use of varying output intensity LEDs is undesired. Close binning or matching of individual nominally equal LEDs, while possible, can render many LED-based general purpose illumination systems substantially cost-ineffective.

An alternative solution which can be used to mitigate the effects of variations in light emission characteristics in nominally equal LEDs is described in U.S. Pat. No. 4,743,897, which describes an LED driver circuit including a current source for generating a constant drive current to a plurality of series connected LEDs, circuitry for selectively enabling and disabling predetermined ones of the LEDs and further circuitry for disabling the current source in the event none of the LEDs are enabled. While the LED driver circuit is of simple design and low cost, and is characterized by relatively low power consumption in comparison to other solutions, the energy efficiency and operational characteristics of this LED driver circuit can be limited.

Therefore, there is a need for a new light-emitting element control system, and lighting system comprising same, that overcomes some of the drawbacks of know systems.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

An object of the present invention is to provide a light emitting element control system and lighting system comprising same. In accordance with one aspect of the present invention, there is provided a light-emitting element control system comprising: a series connection of two or more LEE units, each comprising one or more LEEs and a unit activation module configured to control activation thereof in response to a respective unit activation control signal; a control module operatively coupled to each said unit activation module and configured to generate each said respective unit activation control signal; and a converting module operatively coupled to said series connection of LEE units, said converting module adapted for connection to a source of power and configured to provide a drive current to said LEE units.

In accordance with another aspect of the present invention, there is provided a lighting system comprising: two or more LEE units connected in series, each comprising one or more LEEs and a unit activation module configured to control activation thereof in response to a respective unit activation control signal; a control module operatively coupled to each said unit activation module and configured to generate each said respective unit activation control signal; and a converting module operatively coupled to said LEE units, said converting module adapted for connection to a source of power and configured to provide a drive current to said LEE units.

DETAILED DESCRIPTION OF THE INVENTION

Definitions

Figure 1:
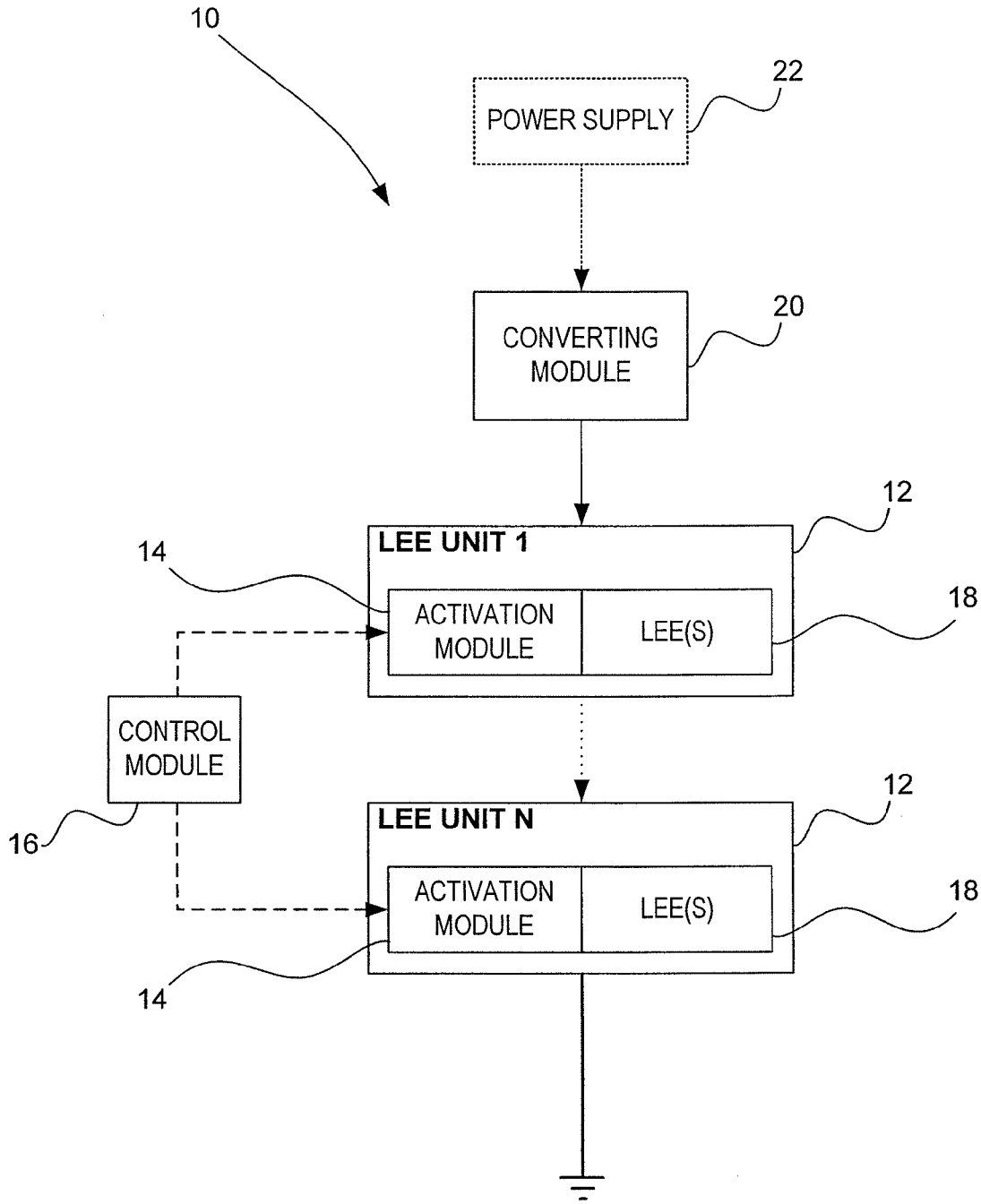
FIG. 1 is a block diagram depicting a light-emitting element control system in accordance with one embodiment of the present invention.

The term "light-emitting element" (LEE) is used to define a device that emits radiation in a region or combination of regions of the electromagnetic spectrum for example, the visible region, infrared and/or ultraviolet region, when activated by applying a potential difference across it or passing a current through it, for example. Therefore a light-emitting element can have monochromatic, quasi-monochromatic, polychromatic or broadband spectral emission characteristics. Examples of light-emitting elements include semiconductor, organic, or polymer/polymeric light-emitting diodes, optically pumped phosphor coated light-emitting diodes, optically pumped nano-crystal light-emitting diodes or other similar devices as would be readily understood by a worker skilled in the art. Furthermore, the term light-emitting element is used to define the specific device that emits the radiation, for example a LED die, and can equally be used to define a combination of the specific device that emits the radiation together with a housing or package within which the specific device or devices are placed.

The term "operational characteristic" is used to define a characteristic of an LEE unit, and/or of LEE(s) thereof, descriptive of an operation thereof. Such characteristics may include electrical, thermal and/or optical characteristics which may in some circumstances, differ from one LEE to another, or one LEE unit to another, even when operating nominally equal LEEs. Examples of operational characteristics may include, but are not limited to, a spectral power distribution, a colour rendering index, a colour quality, a colour temperature, a chromaticity, a luminous efficacy, an operating temperature, a bandwidth, a relative output intensity, a peak intensity, a peak wavelength of a LEE unit and/or of the one more LEE(s) thereof, and/or other such characteristics as will be readily appreciated by the person of ordinary skill in the art.

The term "co-operative relationship" is used to define a relationship between LEE units, and/or LEEs thereof, which, when operated in accordance with this relationship, provides a desired output. For example, a co-operative relationship may be defined based on a desired output provided by the combined outputs of the LEE units, which may include, but is not limited to, a combined spectral power distribution, colour rendering index, colour quality, colour temperature, chromaticity, or the like, or again provided by a substantially same or similar output for each LEE unit irrespective or possible variations and/or differences in the operating characteristics, as defined above, of different LEE units each comprising a nominally same set of one or more LEEs.

As used herein, the term "about" refers to a +/−10% variation from the nominal value. It is to be understood that such a variation is always included in any given value provided herein, whether or not it is specifically referred to.

Unless defined otherwise, all technical and scientific terms used herein have the same meaning as commonly understood in the art to which this invention belongs.

The present invention provides a light-emitting element (LEE) control system that can be used, for example, to control the individual, combined and/or relative output of one or more LEE units in a LEE-based illumination system, and/or to mitigate effects of variations in operational characteristics of LEE units, and/or the LEE(s) thereof, of such a system. For example, the control system can be used in LEE-based illumination systems to mitigate effects of variations in nominal light emission characteristics of the system's LEEs, to control the brightness of the LEE-based illumination system, to control and/or improve the spectral output characteristics of the LEE-based illumination system (e.g. colour rendering index, colour quality, chromaticity, colour temperature, spectral power distribution, etc.), to control and/or improve the drive characteristics of the LEE-based illumination system (e.g. power consumption, power supply requirements, luminous efficacy, etc.), and/or other such purposes as will be readily appreciated by the person of ordinary skill in the art upon reading the following description of illustrative embodiments.

In particular, the light-emitting element control system according to one embodiment of the present invention comprises a series connection of two or more LEE units, each one of which comprising one or more LEEs and a unit activation module configured to control activation thereof in response to a respective unit activation signal. For instance, the activation module associated with a given LEE unit is generally configured to controllably activate and/or deactivate, in response to a unit activation control signal, the one or more LEEs in that unit.

The system further comprises a control module operatively coupled to each unit activation module and configured to generate each respective unit activation control signal based on a co-operative relationship between each LEE unit, and/or LEE(s) thereof, which may be predetermined, tested and/or adaptively defined to provide, for example, a desired co-operative output. Such a relationship may be based on, for example and as defined above, a desired co-operative output to be provided by the combined outputs of the LEE units, or again to be provided by a substantially same or similar output for each LEE unit despite possible variations and/or differences in the operating characteristics of different LEE units each comprising a nominally same set of one or more LEEs.

In one embodiment, the control module is configured to determine and provide the unit activation control signals to each of the activation modules, these signals being determined in an interdependent manner based, for example, on the relative operational characteristics of each of the LEE units, or one or more LEEs thereof, thereby providing a means for compensating for variations in such operational characteristics. Such compensation may be provided, for example, in order to ensure a desired level of light output from all LEE units, or again, in order to ensure a desired color balance dependent on the relative contribution of the different LEE units.

A converting module operatively coupled to the series connection is also provided and adapted for connection to a source of power and configured to provide a drive current to the LEE units.

With reference to FIG. 1, and in accordance with one embodiment of the present invention, a control system 10 is depicted to comprise N LEE units, such as units 12, each comprising an activation module 14 operatively coupled to a control module 16 configured to provide a unit activation control signal thereto (dashed lines), and each operatively coupled to one or more respective LEEs 18 to control activation and/or deactivation thereof in response to the unit activation control signal. The system further comprises a converting module 20 adapted to be operatively coupled to a power supply 22 for providing a drive current to the LEE units 12.

Figure 2:
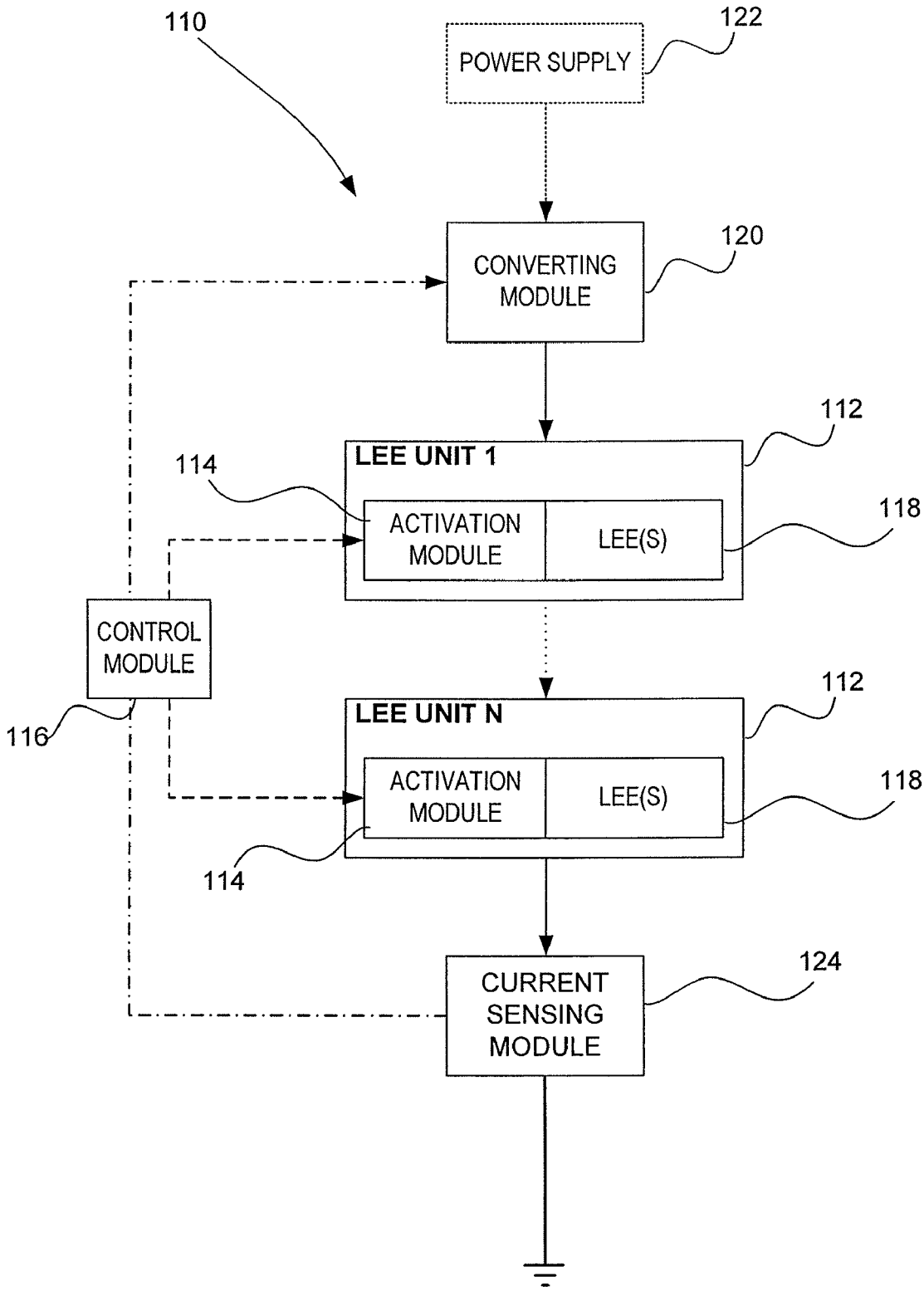
FIG. 2 is a block diagram depicting a light-emitting element control system comprising current feedback control, in accordance with one embodiment of the present invention.

With reference to FIG. 2, and in accordance with another embodiment of the present invention, a light-emitting element control system 110 is again depicted to comprise N LEE units, such as units 112, each comprising an activation module 114 operatively coupled to a control module 116 configured to provide a unit activation control signal thereto (dashed lines), and each operatively coupled to one or more respective LEEs 118 to control activation and/or deactivation thereof in response to the unit activation control signal. The system again comprises a converting module 120 adapted to be operatively coupled to a power supply 122 for providing a drive current to the LEE units 112. In this embodiment, the system 110 further comprises an optional feedback system which can provide a means for controlling the drive current supplied to the series connection of LEE units 112. For example, the feedback system may comprise a drive current sensing module 124 and a drive current control module, depicted herein as a subcomponent of integrated control module 116, comprising for example a signal conditioning mechanism. In general, the drive current sensing module 124 may be configured to detect the drive current being supplied to the series connection of LEE units 112 and communicate a signal indicative thereof (dash-dot line) to the signal conditioning mechanism of the control module 116. The control module 116 may thus provide a drive current control signal (dash-dot line) to the converting module 120, thereby enabling adaptive control over the drive current supplied to the series connection of LEE units 112 during operation. It will be appreciated that a distinct drive current control module may be provided rather than an integrated control module, as depicted herein, without departing from the general scope and nature of the present disclosure.

Figure 3:
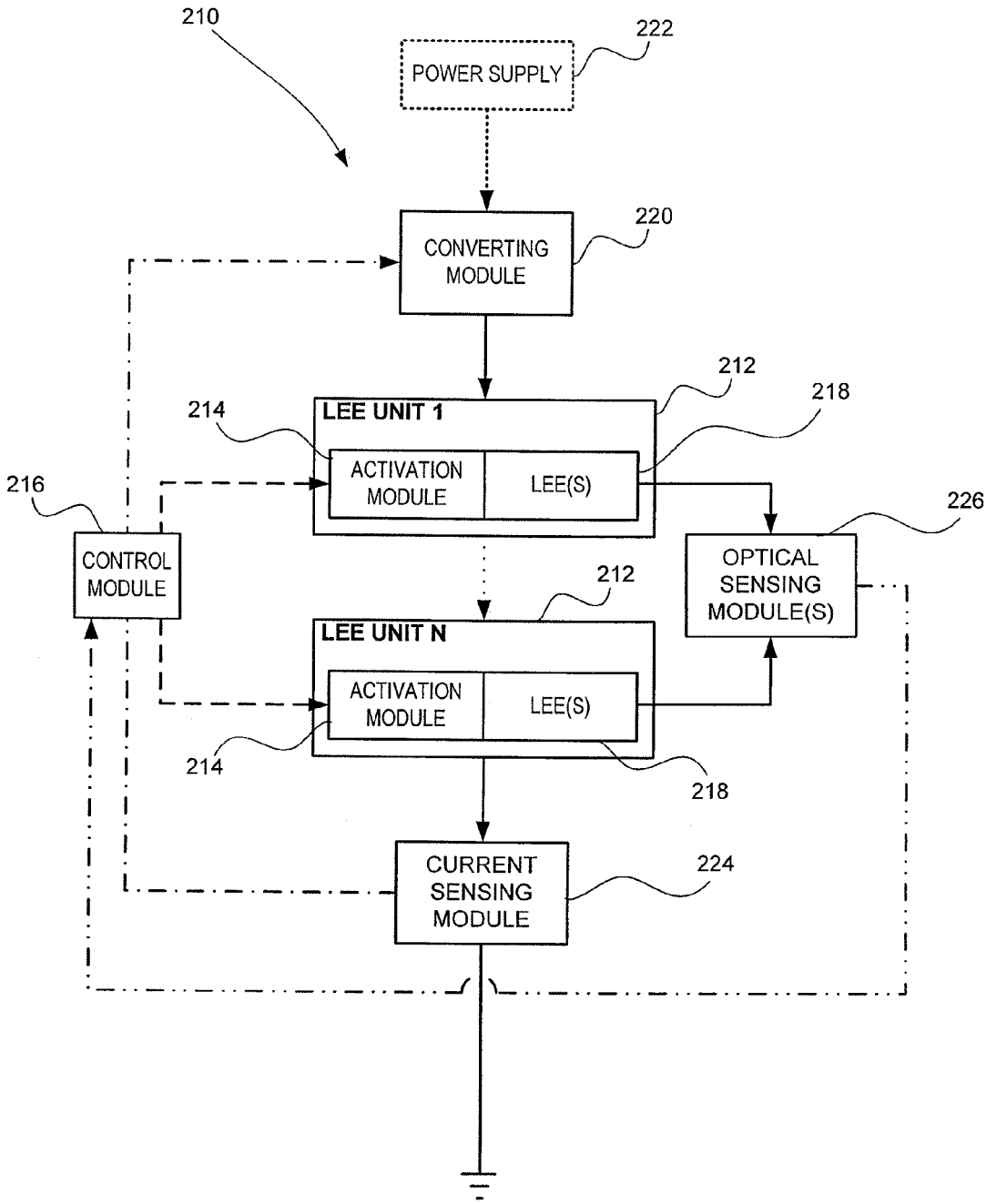
FIG. 3 is a block diagram depicting a light-emitting element control system comprising optical and current feedback control, in accordance with one embodiment of the present invention.

With reference to FIG. 3, and in accordance with another embodiment of the present invention, a light-emitting element control system 210 is again depicted to comprise N LEE units, such as units 212, each comprising an activation module 214 operatively coupled to a control module 216 configured to provide a unit activation control signal thereto (dashed lines), and each operatively coupled to one or more respective LEEs 218 to control activation and/or deactivation thereof in response to the unit activation control signal. The system again comprises a converting module 220 adapted to be operatively coupled to a power supply 222 for providing a drive current to the LEE units 212. In this embodiment, the light-emitting element control system 210 further comprises an optional feedback system which can provide a means for controlling both the drive current supplied to the series connection of LEE units 112 and an optical output thereof. In this embodiment, the feedback system again comprises a drive current sensing module 224 and a drive current control module, depicted herein as a subcomponent of integrated control module 216. The feedback system further comprises an optical sensing module 226 adapted to sense an optical output of one or more of the LEE units, or of one or more of the LEEs thereof. The optical sensing module is further operatively coupled to an optical output control module, depicted herein as a same or distinct subcomponent of the integrated control module 216, to communicate thereto a signal indicative of the sensed optical output (dash-dot-dot line). The optical output control module is operatively coupled to the activation modules 214 for controlling same, responsive to the sensing module signal, and adapting an optical output of the LEEs operatively coupled thereto. In this manner, both the drive current supplied to the series connection of LEE units 212 and the unit activation control signals provided to control an output of the LEEs 218 can be adaptively modified during operation. It will be appreciated that a distinct drive current control module and/or optical output control module may be provided rather than an integrated control module, as depicted herein, without departing from the general scope and nature of the present disclosure. It will be further appreciated that a similar system may be designed to include a feedback system configured to provide optical feedback only.

As will also be apparent to the person of skill in the art that other feedback mechanisms may be considered herein, such as thermal and/or other such operational feedback mechanisms, without departing from the general scope and nature of the present disclosure.

LEE Units

The light-emitting element control system according to one embodiment of the present invention generally comprises a series connection of two or more LEE units, each one of which comprising one or more LEEs and a unit activation module configured to control activation thereof in response to a respective unit activation control signal. For instance, the activation module associated with a given LEE unit is generally configured to controllably activate and/or deactivate, in response to a unit activation control signal, the one or more LEEs in that unit.

Figure 4:
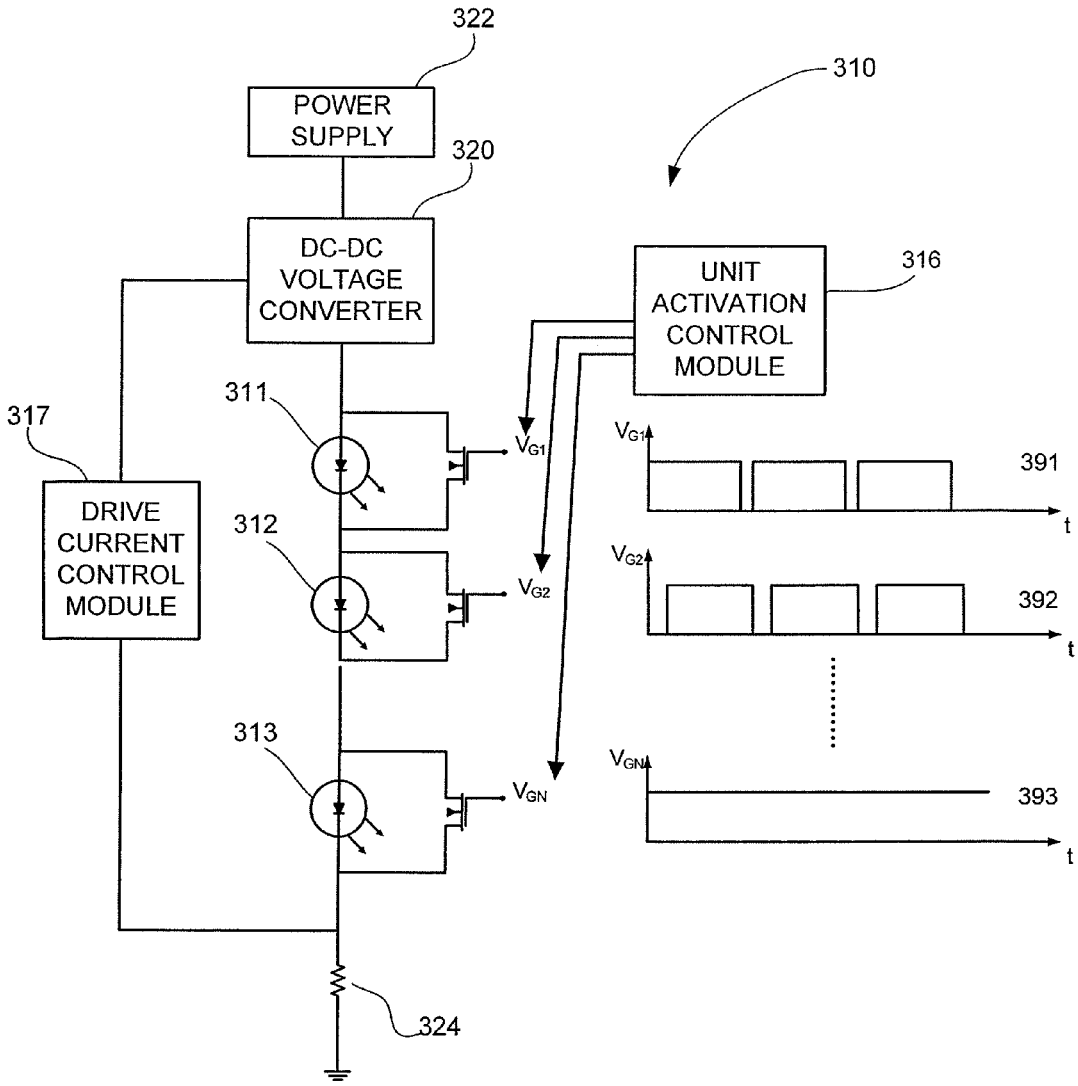
FIG. 4 is a block diagram depicting a light-emitting element control system comprising current feedback control in accordance with one embodiment of the present invention.
Figure 6:
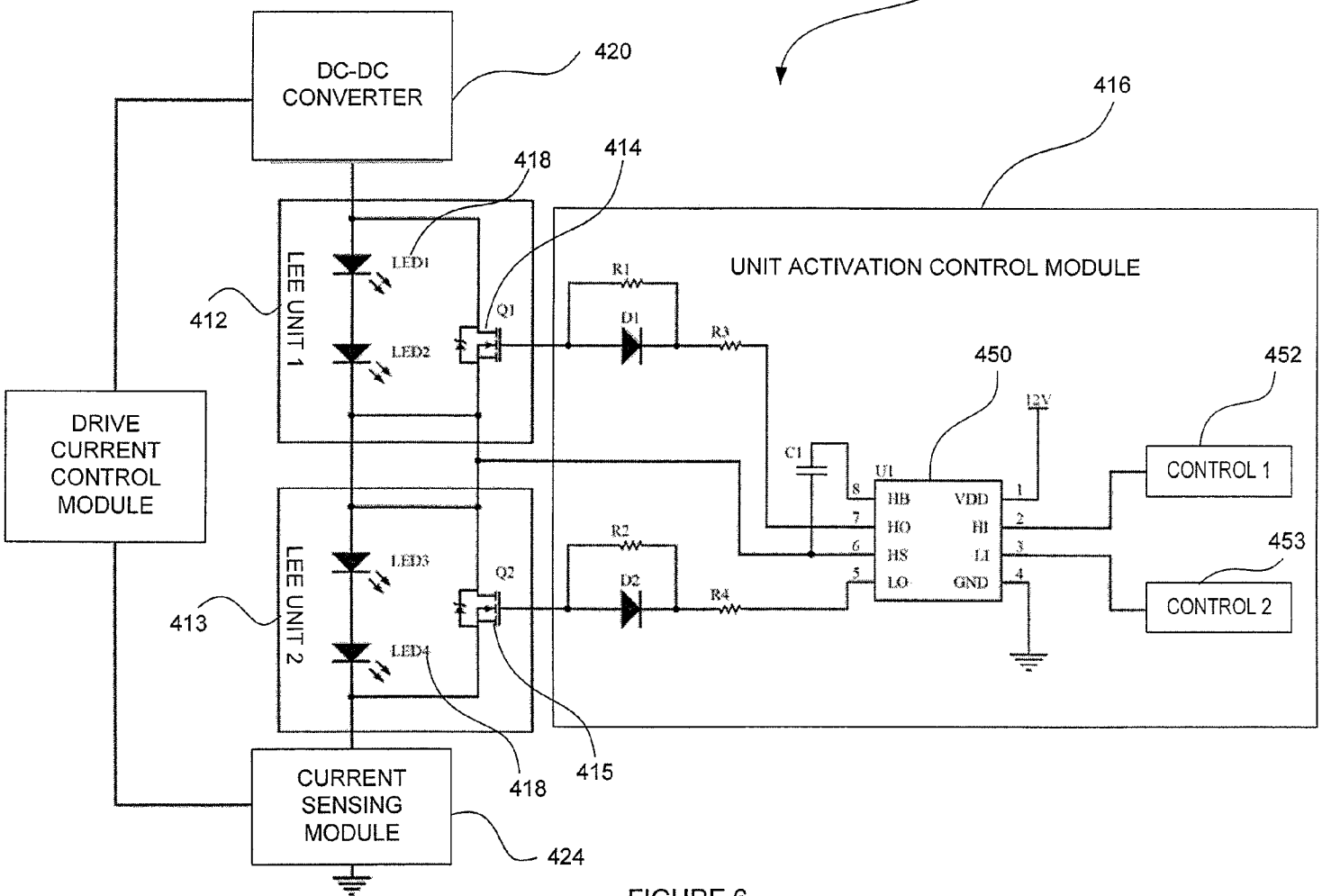
FIG. 6 is a schematic representation of a unit activation control module, in accordance with one embodiment of the present invention.
Figure 7:
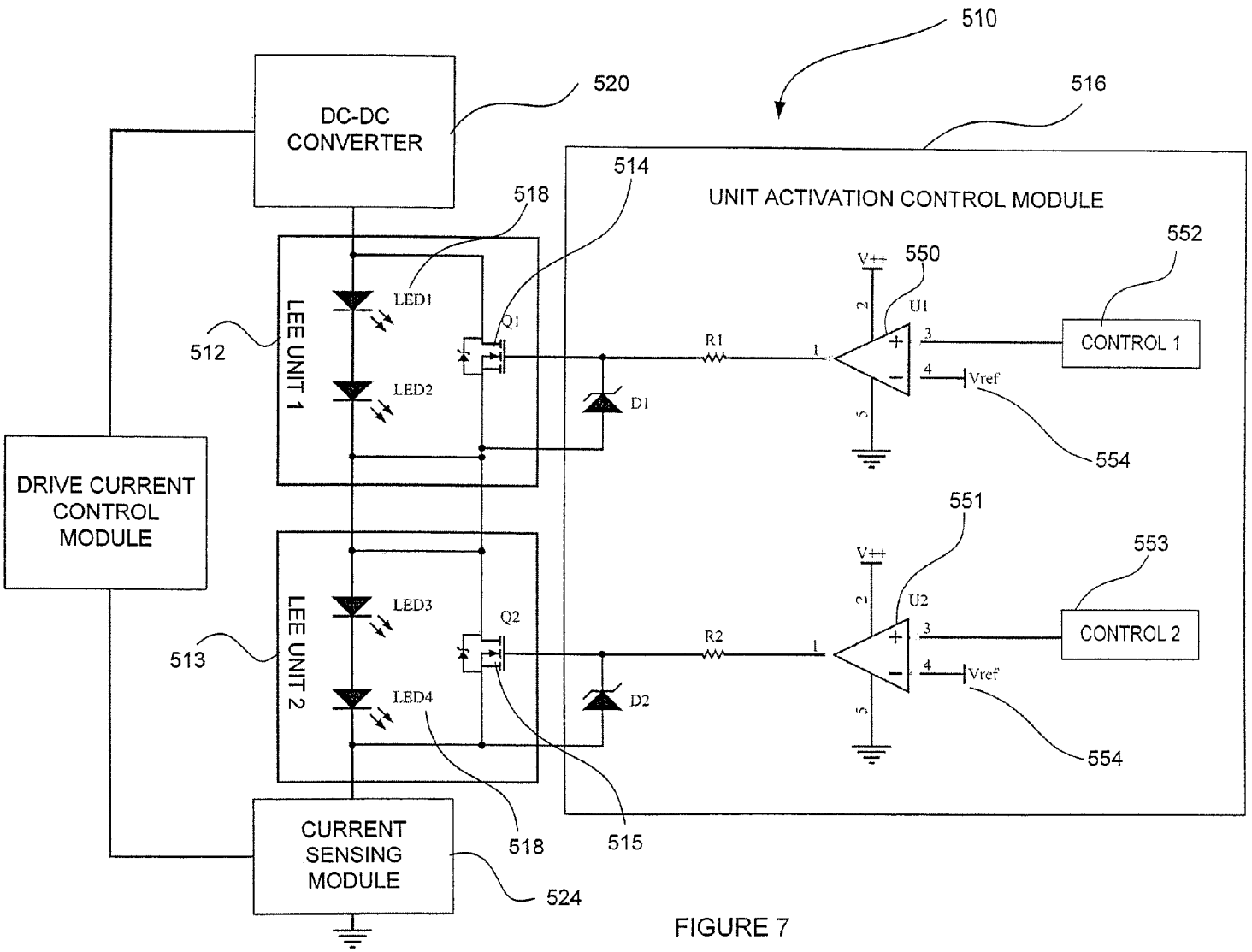
FIG. 7 is a schematic representation of a unit activation control module, in accordance with another embodiment of the present invention.

In one embodiment, the activation module is in parallel electrical connection to the one or more LEEs (for example as schematically depicted by the unit activation modules of FIGS. 4, 6 and 7), which can be connected in series and/or in parallel to one another. The unit activation module can thus be switched between a high and a low resistance configuration during operating conditions, wherein the unit activation module can be used to repetitively deactivate the one or more LEEs in the particular LEE unit. For instance, the deactivation of a particular LEE unit is provided by activating the corresponding unit activation module such that it provides a low resistance path for the current flowing through the one or more LEEs. In this manner the current will bypass or be shunted around the one or more LEEs of the unit whenever its corresponding unit activation module is activated.

In one embodiment, the one or more LEEs in a LEE unit can comprise about equal LEEs, for example, one or more blue LEEs with about equal output-input characteristics.

In another embodiment, a LEE unit can comprise one or more different types of LEEs, for example, red, blue and/or green LEEs, in various combinations, groups and/or clusters.

In another embodiment, different LEE units in the series connection of LEE units can comprise about equal LEEs or different colour LEEs.

In one embodiment, the activation module associated with each of the LEE units of a series connection of LEE units, are configured in the same device format. However, different activation modules can be associated with any one or more of the LEE units of a series connection of LEE units.

In one embodiment, the activation module can be configured as a bipolar transistor or a field effect transistor (FET), such as a Metal Oxide Field Effect Transistor (MOSFET), for example. A worker skilled in the art would readily understand different types of activation modules which can be used in the LEE units.

In some embodiments, each activation module comprises a field effect transistor (FETs). In such embodiments, it may be beneficial to choose a combination of both N and P type FETs. This type of activation module selection may simplify the required gate drive electronics if P-FETs are used for LEE units at the start of a given series connection of units, e.g. near the converter module, and N-FETs are used for LEE units at the end of the series, e.g. close to ground. Such a configuration would however require that the polarity of the signal levels to activate the P-FETs be opposite to that of the activation signals for the N-FETs.

As would be understood by one skilled in the art, the particular activation module used and the voltage level of control signals used to activate said activation module can be chosen appropriately depending on the number of LEEs in the unit, for example.

In one embodiment, the activation module can have a control input which can be operatively connected to a control module, such as a unit activation control module, which can provide a pulse width modulated (PWM) or pulse code modulated (PCM) switching signal, for example.

In one embodiment, the activation module is configured to be capable of switching a LEE unit repetitively at frequencies which are sufficiently high to avoid or limit undesired flicker effects, thermal stress in the LEE(s) and audible noise. Depending on the type of LEE(s) used in a LEE unit, switching frequencies can exceed $10^3$ Hz, for example.

As it will be appreciated by the person of ordinary skill in the art, in typical systems wherein multiple LEEs, or groups, strings, and/or clusters thereof, are independently driven and controlled, each LEE, or group, string and/or cluster thereof, requires its own converting module, which thus requires a large number of components and produces a certain amount of power loss associated therewith. In various embodiments of the present invention, however, each LEE, or group, cluster and/or string thereof, is provided as part of a LEE unit comprising its own unit activation module, each unit linked in series, thereby allowing for a reduction in the number of converting modules required, and thus, in associated power losses. Therefore, in accordance with some embodiments, the number and cost of required components and the overall system efficiency of the system may be improved while still allowing for independent control of multiple LEEs, LEE groups, LEE clusters and/or LEE strings—i.e. of multiple LEE units.

As will be understood by one skilled in the art, even though the same peak current will flow in each of the LEE units activated within the serial connection of units, by applying appropriate activation signals to the unit activation modules of these activated units, as previously discussed, the average current through the LEEs therein can be controlled to a different level, thereby providing the desired co-operative effect.

Control Module

The system generally comprises a control module operatively coupled to each unit activation module and configured to generate each respective unit activation control signal based on a co-operative relationship, which can be predetermined, tested and/or adaptively defined, between the one or more LEEs in each of the LEE units. For instance, the control module may be configured to determine and provide the unit activation control signals to each of the activation modules, these signals being determined in an interdependent manner based, for example, on the relative operational characteristics of each of the LEE units, thereby providing a means for compensating for variations in such operational characteristics and/or providing a means for implementing a desired balance between the outputs thereof based on such characteristics.

In one embodiment, the control module is configured to generate one or more activation control signals, wherein a particular activation control signal is used to control the activation of the one or more LEEs in a particular LEE unit.

The control module can be configured as a computing device or microcontroller having a central processing unit (CPU). The control module has one or more storage media collectively referred to herein as memory, operatively coupled thereto. The control module can be configured to include the memory. The memory can be volatile and non-volatile computer memory such as RAM, PROM, EPROM, and EEPROM, or the like, wherein control programs (such as software, microcode or firmware) for monitoring or controlling devices coupled to the control module are stored and executed by the CPU.

In one embodiment, the control module also provides the means of converting user-specified operating conditions into control signals to control the devices coupled to the control module. The control module can receive user-specified commands by way of a user interface, for example, a keyboard, a touchpad, a touch screen, a console, a visual or acoustic input device or other user interface as is well known to those skilled in this art.

The control module may be configured such that it comprises data relating to the luminous flux output of each of the LEE units. In one embodiment of the present invention, the control module is preloaded with the luminous flux output data during manufacture when the luminous flux output of the LEE units is predetermined. In another embodiment, such data is updated dynamically via one or more feedback mechanisms, for example.

In another embodiment of the present invention, the control module is configured to calibrate this luminous flux output data post manufacture. This can be performed by for example a device calibration using an external optical sensing device or can be performed using an optical sensor associated with the control module. The external optical sensing device or the optical sensor can be configured to detect the output of each of the LEE units independently and thereby provide a means for the determination of the luminous flux output data regarding each of the LEE units.

In one embodiment of the present invention, in order to account for luminous flux output variations between the LEE units, the control system can determine activation control signals based on the LEE unit having the lowest luminous flux output. The control module can be configured to operate the LEE unit with the lowest luminous flux output at full output and operate the other LEE units at fractions of their luminous flux output, wherein the fraction for a particular LEE unit can be determined based on the ratio of luminous flux output of the LEE unit in question with respect to the lowest luminous flux output of a LEE unit. This format of activation control signal generation can provide a means for mitigating the variation of luminous flux output of a series of LEE units, for example.

In another embodiment of the present invention, the control module can be configured to determine the activation control signals based on a desired light output by an illumination system including the LEE control system according to the present invention. The specific activation control signal for each LEE unit can be determined in an interdependent manner and can be based on the required colour of light output from the illumination system, and the relative luminous flux output of the LEE units themselves.

The control module can be configured to generate the activation control signals which can be based on pulse width modulation or pulse code modulation. Other formats of activation control signals would be readily understood by a worker skilled in the art.

As will be described below in relation to an embodiment of the control system comprising an optional feedback system, the control module may comprise a single integrated control module, comprising for example a unit activation control subcomponent, a drive current control subcomponent, an optical output control subcomponent and/or other such subcomponents; distinct control modules; and/or a combination thereof.

Converting Module

The LEE control system further comprises a converting module whose input is adapted to be connected to a power supply. The output of the converter module may be connected to the series connection of LEE units to which it may provide electrical power with a certain output voltage.

In one embodiment, the converter module can comprise an AC-DC type or a DC-DC type converter. While the converter module can be of either type, it may work well with AC as well as DC input voltages.

In one embodiment, the converter module may comprise one or more of a general switch mode, buck, boost, buck-boost, fly-back and cuk converter, for example. Other forms of converter modules, for example transformer and rectifier combinations, can also be used as would be readily understood by a worker skilled in the art.

The selection of a converter module can be based, for example, on output voltage requirements, which may be needed for rapidly changing load conditions while maintaining a substantially constant output current. For example, in an embodiment wherein the unit activation module of each unit is connected in parallel with the LEE(s) of the unit and wherein deactivation of a given unit is implemented by shunting the current around the LEE(s) of that unit, changes in the total string voltage for a particular current will be manifested depending on how many units are activated/deactivated. This is in part due to the fact that the unit activation modules in this scenario will have a low resistance and thus there will be a much lower voltage drop across them when activated in comparison to when the one or more LEEs associated therewith are activated. Therefore the converter module should be able to compensate for a rapid change in voltage in order to continue to provide a relatively constant current even if one or more units are being deactivated at a high frequency by their respective unit activation modules. In general, the speed at which the converter module can adjust for changes in voltage can, in some embodiments, limit the frequency at which the units can be deactivated.

In one embodiment, the requirements on the converter module to adjust rapidly to large changes in voltage can be eased by including a higher resistive element in the shunt path defined by a particular activation module in order to about match the voltage drop over the one or more LEEs associated therewith. This configuration however, would dissipate more power during deactivation of a given unit and thus could be deemed less efficient.

In another embodiment, a unit activation module can be operated in a linear mode rather than a saturation mode such that it may have a higher resistance, which can again about match the voltage drop across the unit. Again, this configuration could dissipate more power during deactivation of the one or more LEEs, and thus could be deemed less efficient.

In another embodiment, the converter module is selected such that it may quickly adjust its output voltage, thereby enabling it to substantially maintain a constant current while enabling the activation modules to be driven to saturation, leading to a substantially high efficiency when shunting current around the one or more LEEs of each unit. For example, a hysteretic buck converter with small output capacitance can be used as a converting module, which is generally able to rapidly respond to sudden changes in output load voltage and is quickly able to recover and achieve tight regulation after such a change.

In one embodiment, the converter module comprises a control input which may be connected to a feedback system. For example in one embodiment, the converter module is connected to the output of a drive current control module or signal conditioner (e.g. provided via a distinct or integrated control module). In this configuration, the converter module can adjust the output voltage in accordance with the strength of the drive current signal provided at its control input under operating conditions, thereby providing a means for maintaining a desired drive current through the series connection of LEE units.

Optional Feedback System

In one embodiment of the present invention, the LEE control system further comprises a feedback system which can provide a means for controlling one or more operational characteristics of the system.

For example, in one embodiment, a feedback system is provided to substantially maintain a relatively constant drive current through the series connection of LEE units (e.g. see FIGS. 2 to 4, 6 and 7). The feedback system can comprise a drive current sensing module which can be operatively connected to the LEE series connection. Under operating conditions the drive current sensing module can sense the drive current through the LEE series connection and provide a drive current signal indicative of this current. The drive current sensing module may be configured to provide a drive current signal which indicates a measure of the drive current through the series connection of LEE units.

In one embodiment, the drive current sensing module can be a drive current sensor configured as an ohmic resistor or a Hall probe connected in series with the one or more LEE units, for example. Other drive current sensors which can provide the desired detection of drive current would be readily understood by a worker skilled in the art.

The feedback system may further comprise a drive current control module, such as a signal conditioning mechanism or the like configured as part of a feedback loop and operatively connected to the drive current sensing device. The signal conditioning mechanism can process the drive current signal and provide a drive current control signal at an output thereof, which can be used by the converter module in order to control the output voltage generated thereby.

In one embodiment, the signal conditioning mechanism is a signal conditioner which can comprise a combination of proportional (P), integral (I) and/or differential (D) analog or digital filter elements. Digital filtering may require additional analog-digital and digital-analog converters which can be integrated into the signal conditioner. As will be appreciated by the person of ordinary skill in the art, various combinations of P, I and D filter elements with adequate filter characteristics may be used to greatly improve the dynamics of the feedback loop.

In one embodiment, the signal conditioner is implemented in digital form, the configuration of which would be readily understood by a worker skilled in the art. A digital format signal conditioner can provide greater flexibility in the design of its input-output or filter characteristics as would be understood by a worker skilled in the art.

In one embodiment, the feedback system can be configured to realize a feedback loop in which the drive current can be maintained within predetermined limits. These limits can depend on certain characteristics of the components of the LEE control system which are part of the feedback loop, as will be understood by the worker skilled in the art.

The system may further or alternatively comprise an optical feedback system for controlling an optical output of the lighting system to attain or maintain a desired output. For example, a desired dimming and/or spectral characteristic may be achieved and maintained using a feedback mechanism, as can such characteristics be monitored and adapted when needed.

As well as being applicable to single or fixed colour luminaires, the present invention can also be implemented in variable colour luminaires, for example, colour changing strip luminaires. It is noted that the overall brightness can independently be controlled by controlling the current through the series connection of LEE units.

In one embodiment of the present invention, the LEE control system can comprise a light detector for detecting the amount of light emitted by the LEEs. This configuration can provide for initial or periodic calibration or for optional optical feedback control of the output of the LEE units (e.g. see FIG. 3).

In yet another embodiment, the optical sensing module could be configured to detect ambient light, either integrally or distinctly, which could be used as a form of negative feedback to control the activation of the LEEs. For example, in such embodiments, ambient light measurements could be used such that at higher ambient light levels, for example, a lower overall output level may be desired from the lighting system leading to a reduction in the activation signals to the LEEs. Furthermore, in an embodiment wherein the LEEs of the lighting system are comprised of different colour LEEs (for example, in a mixed light luminaire system), the optical sensing module could be selected as to be sensitive to ambient light wavelength information such that the system can act to reduce the output of the corresponding LEE colour to maintain both a set intensity and a desired colour balance, for example.

Other examples of feedback mechanisms and systems, such as thermal feedback mechanisms, should be apparent to the person of skill in the art and are therefor not meant to depart from the general scope and nature of the present disclosure.

The invention will now be described with reference to specific examples. It will be understood that the following examples are intended to describe embodiments of the invention and are not intended to limit the invention in any way.

EXAMPLE 1

FIG. 4 provides a block diagram of an illumination system comprising a LEE control system 310 according to one embodiment of the present invention. The LEE control system comprises a power supply 322, a conversion module in the form of a DC-DC voltage converter 320, a drive current control module or signal conditioner 317, a current sensing module configured as resistor 324 and a series connection of N LEE units 311, 312 to 313. Each one of the N LEE units 311, 312 to 313 comprises an activation module configured as a field effect transistor which is in parallel electrical connection to the one or more LEEs in the respective LEE units. The gate electrodes of each field effect transistor can be connected to a unit activation control module 316, which in this embodiment is depicted as distinct from the drive current control module 317, for providing switching or activation signals to each of the LEE units, thereby providing a means for individual operational control of each of the LEE units. Example time resolved profiles 391, 392 and 393 of gate voltages $V_{G1}$, $V_{G2}$ to $V_{GN}$ for the field effect transistors in LEE units 311, 312 to 313, respectively, are also illustrated in FIG. 4.

In this embodiment, the signal conditioner 317 probes the voltage drop across resistor 324 which acts as a current sensor. The signal conditioner 317, as generally described above, provides a feedback signal for DC-DC converter 320. The current through a LEE unit flows substantially either through the LEE(s) or through the field effect transistor. Hence the LEE(s) in an LEE unit can be driven with an adequate electrical current or can be turned off, depending on whether the field effect transistor is switched to assume either a high or a low drain-source resistance configuration.

Modes of Operation

The activation modules, or field effect transistors in this example, can be operated in a number of different ways. For example, if all LEE units comprise the same number of nominally equal LEEs, one way to operate the activation modules is to leave the LEE unit which emits the least amount of light constantly on, in this example LEE unit 313, while the other LEE units 311 and 312 are adequately pulsed to reduce their overall light emissions to the level of least bright LEE unit 313. This can be useful if the LEE control system is used, for example, in an illumination application which requires all LEEs to emit the same amount of light.

In one embodiment of the present invention, if the LEE control system is intended to be implemented with more than one LEE per LEE unit, nominally equal LEEs can be grouped or additionally binned during manufacturing by sorting them into groups of equal number LEEs with closer matching light-emitting characteristics. Each such group can then be used to supply the LEEs used to implement one LEE unit.

In one embodiment, a calibration process after installation of the LEE control system, for example, can help configure the control system and adapt the way it generates activation control signals for the LEE units during operating conditions. It is noted that the electrical current through a series connection of LEE units can be controlled independently from the activation modules, for example, to change the overall amount of light emitted by the LEEs.

The amount of light emitted by the LEEs in one of the LEE units can be controlled using the respective activation modules. It is noted that, if adequately mixed, any colour light can be generated by using LEE units which comprise LEEs which emit light of a suitable colour. The activation modules can be controlled in a pulsed fashion. For example, they can be activated and deactivated following a PWM or PCM scheme. It is noted that it may be desirable to adjust the voltage across the series connection of LEE units during pulse modulation to cause a desired drive current within a narrow range. This can effectively improve the stability of the output current of the converting module (e.g. voltage converter 320) under operating conditions.

In one embodiment of the present invention, the voltage converter 320 is required to provide an output voltage across the series connection of LEE units which is governed by the activation control signals at a control input of the respective activation modules.

In another embodiment, the converting module 320 provides a constant current through to the series of LEE units either by means of the current sensing module 324, or an internal (eg: high side) current sensor in the converting module itself. In such an embodiment, when a particular LEE unit is activated, in order to maintain constant current through the entire series connection of LEE units, the converting module would generally have to increase its output voltage by an amount about equal to the voltage drop required by the LEE(s) in this activated unit, thus drawing more power from the power supply 322. Similarly, when a particular LEE unit is deactivated, for example by means of a bypass or shunt switch to divert current around the LEE(s) in that unit (e.g. via an appropriate unit activation module), in order to maintain constant current the converting module would generally have to decrease its output voltage, otherwise the extra voltage would appear across other activated LEE units causing their current to spike. Therefore, by decreasing the voltage and maintaining a constant current, less power is drawn from the power supply.

In the case where all LEE units are deactivated, the converter module could continue to deliver constant current, but its output voltage would necessarily drop to nearly zero, thus reducing the power draw from the power supply to nearly zero as well. The only elements which would have any voltage dropped across them would be the activation modules, in each LEE unit and the current sensing element (e.g. resistor of FIG. 4) in the current sensing module 324.

Therefore, in one embodiment, in order to maintain a high system efficiency, the activation modules, depicted herein as shunt switches, are optionally chosen to be of a type which have a low on-resistance to minimize the power draw when LEE units are deactivated. For example, FET switches may be selected rather than BJT transistors to provide such improvement. Similarly the resistance of the current sensing module can also optionally be reduced to promote a low voltage drop and hence a low power loss while still providing a sufficiently accurate measurement of the current to provide a reliable control signal back to the control and converter modules.

EXAMPLE 2

FIG. 6 provides an example of unit activation control module appropriate for use with a system wherein each unit activation module comprises a FET switch. In this embodiment, care is taken to properly drive the FET switches to maintain appropriate voltage differentials between the gate and the source, so to reduce effects that activation or deactivation of one LEE unit may have in the overall voltage levels, which could interfere with the activation or deactivation of the FET switch in an adjacent LEE unit in the series connection.

In this example, a system 410 comprises two LEE units, i.e. LEE Unit 1 (412) and LEE Unit 2 (413), each comprised of 2 or more LEEs, such as LEEs 418, in parallel with a unit activation module, such as single N-channel MOSFET switches 414 (Q1) and 415 (Q2) of Units 412 and 413 respectively. A DC-DC converter 420 provides a constant current and an output voltage as high as the total voltage drop of all the LEEs in the series connection in addition to the drop across a current sensing module 424.

The activation control module 416 generally comprises a level shifter 450 (U1) that accepts logic level input activation control signals, such as Control 1 (452) and Control 2 (453), corresponding to units 412 and 413 respectively. In this example, the LO output of the level shifter 450 to switch 415 provides a buffered signal reference capable of applying a 0-10 volt signal to the gate of this switch. The HO output of the level shifter 450 provides a boosted and buffered signal to the gate of switch 414. The capacitor C1 along with internal circuitry in the level shifter 450 provides a boosted reference voltage relative to the source of switch 414, which partakes in mitigating drastic voltage changes affected by whether or not switch 415 is activated. Diodes D1 and D2 along with resistors R1, R2, R3 and R4 are optionally included to modify the rise and/or fall time of the gate signals as desired for optimal system performance.

As will be understood by those skilled in the art, the specific level shifter 450 depicted in FIG. 6 is provided as an example only and comprises only one of many such devices, such as similar integrated IC level shifters, FET drivers and/or comparable arrangements of discrete components, that could be used in the present context to provide adequate driving signals to the N-channel MOSFETS. The use of these and other such devices, such as for example operational amplifiers, BJTs in push-pull configurations, and the like, are therefore not meant to depart from the general scope and nature of the present disclosure.

EXAMPLE 3

FIG. 7 provides another example of unit activation control module appropriate for use with a system wherein each unit activation module comprises a FET switch. In this embodiment, care is again taken to properly drive the FET switches to maintain appropriate voltage differentials between the gate and the source, so to reduce effects that activation or deactivation of one LEE unit may have in the overall voltage levels, which could interfere with the activation or deactivation of the FET switch in an adjacent LEE unit in the series connection.

In this example, a system 510 again comprises two LEE units, i.e. LEE Unit 1 (512) and LEE Unit 2 (513), each comprised of 2 or more LEEs, such as LEEs 518, in parallel with a unit activation module, such as single N-channel MOSFET switches 514 (Q1) and 515 (Q2) of Units 512 and 513 respectively. A DC-DC converter 520 provides a constant current and an output voltage as high as the total voltage drop of all the LEEs in the series connection in addition to the drop across a current sensing module 524.

In this example, the activation control module 516 generally comprises respective comparators 550 (U1) and 551 (U2) configured to accept logic level input activation control signals, such as Control 1 (552) and Control 2 (553), corresponding to units 512 and 513 respectively. A reference voltage 554 is applied to the negative inputs of the comparators 552 and 553 to ensure a stable reference point which the Control signals must exceed to turn the MOSFETs on. A high voltage (V++), which is generally set to be greater than the output voltage of the DC-DC converter 520 for all applicable conditions, is also applied to the gates of the MOSFETs 514, 515 in response to the logic level input signals 552 and 523. Zener diodes D1 (556) and D2 (557) are also included to ensure that the gate-source breakdown voltage of the MOSFETs 514, 515 is not exceeded. Finally, resistors R1 and R2 are optionally included to limit the gate drive current or change the switching characteristics of the MOSFETs 514, 515 as required for optimal system performance.

Again, other integrated or discrete components such as operational amplifiers, BJTs in push-pull configurations, etc. could be used in various combinations to generate the necessary drive signals while protecting the MOSFETs 514, 515 from excessive gate-source voltages which could damage them, and are thus not meant to depart from the general scope and nature of the present disclosure.

EXAMPLE 4

In accordance with another embodiment comprising two or more LEE units, as shown for example in the embodiments of FIGS. 6 and 7, a P-channel MOSFET can be used in place of the N-channel MOSFET in the first LEE unit (e.g. MOSFET 414 or MOSFET 514 in FIGS. 6 and 7, respectively). In such embodiments, the need for boosted or level shifted gate drive signals, as described in the examples above, could be eliminated since its source could be tied to the high level output voltage of a DC-DC converter, thereby greatly simplifying the gate drive requirements and gate drive circuitry used therefor. It will be appreciated, however, that such embodiments would still generally require the use of N-channel MOSFETs for subsequent units, using gate drive solutions as described above with reference to FIGS. 6 and 7.

EXAMPLE 5

In another example of an illumination system comprising two or more LEE units, the power drawn from a source of power by the system's converting module is maintained within predetermined limits by adequately phase shifting the unit activation control signals relative to one another.

Figure 5:
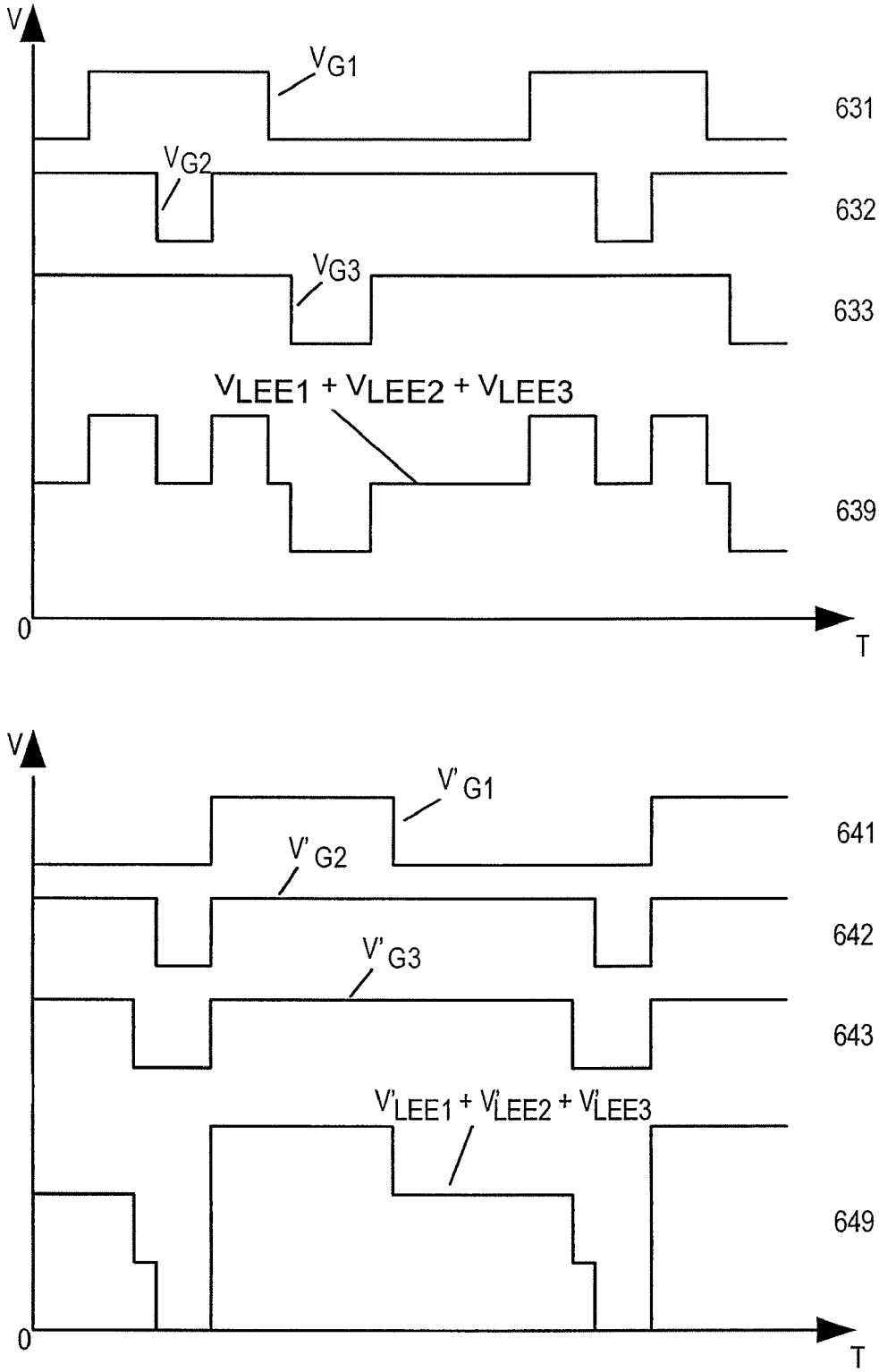
FIG. 5 schematically illustrates timing diagrams of control signals according to different embodiments of the present invention.

FIG. 5 illustrates, in accordance with one embodiment, an example of how the voltage across three LEE units varies if phase shifted unit activation control signals are applied versus synchronous unit activation control signals. As illustrated in FIG. 5, three activation control signals $V_{G1}$ 631, $V_{G2}$ 632 and $V_{G3}$ 633 are phase shifted relative to one another, and when applied, create a total load voltage over time of $V_{LEE1}+V_{LEE2}+V_{LEE3}$ 639. Also illustrated in FIG. 5, unit activation control signals of the same shape and same period, but provided synchronously, are illustrated as $V'_{G1}$ 641, $V'_{G2}$ 642 and $V'_{G3}$ 643. The total load voltage over time corresponding to the application of these synchronous signals add up to $V'_{LEE1}+V'_{LEE2}+V'_{LEE3}$ 649. As can be see by this example, the total load voltages over time 639 and 649 illustrate how, through the phase shifting of the unit activation control signals, the changes in load voltage, and hence changes in the power drawn from the power supply over time can be reduced. Accordingly, such activation methods may provide for the selection of a smaller power supply as the peak power required may be less when the activation control signals are phase shifted relative to one another rather than synchronous. In addition, since the relative voltage changes are small, output requirements of the converting module are eased when considering rapidly changing loads, thereby making the maintenance of a desired drive current an easier task for the converting module.

It is clear that the foregoing embodiments of the invention are exemplary and can be varied in many ways. Such present or future variations are not to be regarded as a departure from the spirit and scope of the invention, and all such modifications as would be obvious to one skilled in the art are intended to be included within the scope of the following claims.

We claim:

1. A control system for two or more serially connected LEE units, each LEE unit (i) comprising one or more LEEs and a unit activation module configured to control activation thereof in response to a respective unit activation control signal and (ii) being configured to emit light substantially in the same spectrum, the control system comprising:

a control module operatively coupled to each said unit activation module and configured to generate each of said respective unit activation control signal based on a cooperative relationship between said LEE units so as to mitigate variations in operational characteristics between said LEEs units, wherein said cooperative relationship assessed from operational characteristics of said LEEs during an operation of the control system;

a feedback system configured to sense an output of the LEE units such that the cooperative relationship is determined during the operation of the control system; and a converting module operatively coupled to said LEE units, said converting module adapted for connection to a source of power and configured to provide a drive current to said LEE units.

2. The light-emitting element control system according to claim 1, further comprising a drive current sensing module operatively coupled to said series connection of LEE units and to said control module, said control module being operatively coupled to said conversion module and configured to evaluate said drive current and control same.

3. The light-emitting element control system according to claim 1, wherein said drive current sensing module comprises one or more of an ohmic resistor and a Hall probe.

4. The light-emitting element control system according to claim 1, further comprising an optical output sensing module operatively coupled to said control module and configured to sense an optical output of one or more of said one or more LEEs, said control module configured to evaluate said optical output and control same.

5. The light-emitting element control system according to claim 1, wherein one or more of said LEE units comprises two or more LEEs connected in series.

6. The light-emitting element control system according to claim 1, wherein one or more of said LEE units comprises two or more LEEs connected in parallel.

7. The light-emitting element control system according to claim 1, wherein for one or more of said LEE units, said unit activation module is connected in parallel with said one or more LEEs associated therewith.

8. The light-emitting element control system according to claim 1, each said respective unit activation control signal comprise a PWM signal or a PCM signal.

9. The light-emitting element control system according to claim 1, wherein each said respective unit activation control signal is phased shifted relative to one another.

10. The light-emitting element control system according to claim 1, wherein said control module comprises a unit activation control module operatively coupled to each said unit activation module and a drive current control module distinct therefrom and operatively coupled between said drive current sensing module and said conversion module.

11. The light-emitting element control system according to claim 10, wherein one or more said unit activation modules comprises a transistor.

12. The light-emitting element control system according to claim 11, wherein the transistor is a field effect transistor.

13. A lighting system comprising:

two or more LEE units connected in series, each LEE unit (i) comprising one or more LEEs and a unit activation module configured to control activation thereof in response to a respective unit activation control signal and (ii) being configured to emit light substantially in the same spectrum;

a control module operatively coupled to each said unit activation module and configured to generate each of said respective unit activation control signal based on a cooperative relationship between said LEE units so as to mitigate variations in operational characteristics between said LEE units, wherein said co-operative relationship is determined adaptively based on an output of the LEE units during an operation of the lighting system; and a converting module operatively coupled to said LEE units, said converting module adapted for connection to a source of power and configured to provide a drive current to said LEE units.

* * * * *